US009140490B2

(12) United States Patent
Minta et al.

(10) Patent No.: US 9,140,490 B2
(45) Date of Patent: Sep. 22, 2015

(54) NATURAL GAS LIQUEFACTION PROCESSES WITH FEED GAS REFRIGERANT COOLING LOOPS

(75) Inventors: Moses Minta, Missouri City, TX (US); John B. Stone, Kingwood, TX (US); Raymond Scott Feist, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 863 days.

(21) Appl. No.: 12/668,811

(22) PCT Filed: Jun. 26, 2008

(86) PCT No.: PCT/US2008/008027

§ 371 (c)(1),
(2), (4) Date: Jan. 12, 2010

(87) PCT Pub. No.: WO2009/029140

PCT Pub. Date: Mar. 5, 2009

(65) Prior Publication Data

US 2010/0186445 A1 Jul. 29, 2010

Related U.S. Application Data

(60) Provisional application No. 60/966,022, filed on Aug. 24, 2007.

(51) Int. Cl.
*F25J 1/00* (2006.01)
*F25J 1/02* (2006.01)

(52) U.S. Cl.
CPC ..... *F25J 1/0035* (2013.01); *F25J 1/004* (2013.01); *F25J 1/005* (2013.01); *F25J 1/0022* (2013.01);

(Continued)

(58) Field of Classification Search
CPC ..... F25J 1/0022; F25J 1/0035–1/0045; F25J 1/0082; F25J 1/0092; F25J 1/0215; F25J 1/0288; F25J 2230/30; F25J 2270/04–2270/08; F25J 1/0201; F25J 1/0202; F25J 1/025; F25J 2270/02
USPC ..... 62/612, 611, 613, 614
See application file for complete search history.

(56) References Cited

U.S. PATENT DOCUMENTS 3,162,519 A * 12/1964 De Lury James et al. ..... 62/613
3,323,315 A 6/1967 Carr (Continued)

FOREIGN PATENT DOCUMENTS

DE 195 17 116 C1 6/1996
WO WO 95/27179 10/1995

(Continued)

OTHER PUBLICATIONS

Foglietta, J. H., "Consider dual independent expander refrigeration for LNG production: New methodology may enable reducing cost to produce stranded gas", *Hydrocarbon Processing*, Jan. 2004, pp. 39-44, Gulf Publishing, vol. 83, No. 1, Houston, TX.

(Continued)

*Primary Examiner* — Frantz Jules
*Assistant Examiner* — Keith Raymond
(74) *Attorney, Agent, or Firm* — ExxonMobil Upstream Research Company

(57) ABSTRACT

The described invention relates to processes and systems for treating a gas stream, particularly one rich in methane for forming liquefied natural gas (LNG), the process including: (a) providing a gas stream; (b) providing a refrigerant; (c) compressing the refrigerant to provide a compressed refrigerant; (d) cooling the compressed refrigerant by indirect heat exchange with a cooling fluid; (e) expanding the refrigerant of (d) to cool the refrigerant, thereby producing an expanded, cooled refrigerant; (f) passing the expanded, cooled refrigerant to a first heat exchange area; (g) compressing the gas stream of (a) to a pressure of from greater than or equal to 1,000 psia to less than or equal to 4,500 psia; (h) cooling the compressed gas stream by indirect heat exchange with an external cooling fluid; and heat exchanging the compressed gas stream with the expanded, cooled refrigerant stream.

8 Claims, 3 Drawing Sheets

(52) U.S. Cl.
CPC ..... *F25J 1/0037* (2013.01); *F25J 1/0042* (2013.01); *F25J 1/0045* (2013.01); *F25J 1/0072* (2013.01); *F25J 1/0082* (2013.01); *F25J 1/0092* (2013.01); *F25J 1/025* (2013.01); *F25J 1/0215* (2013.01); *F25J 1/0219* (2013.01); *F25J 1/0254* (2013.01); *F25J 1/0288* (2013.01); *F25J 2210/06* (2013.01); *F25J 2220/62* (2013.01); *F25J 2230/30* (2013.01); *F25J 2270/02* (2013.01); *F25J 2270/04* (2013.01); *F25J 2270/08* (2013.01)

(56) References Cited

U.S. PATENT DOCUMENTS

| | | | | | |
|---|---|---|---|---|---|
| 3,383,873 | A | | 5/1968 | Becker | |
| 3,616,652 | A | * | 11/1971 | Engel | 62/613 |
| 3,677,019 | A | | 7/1972 | Olszewski | |
| 3,735,600 | A | * | 5/1973 | Dowdell et al. | 62/619 |
| 4,147,525 | A | | 4/1979 | Bradley | |
| 4,179,897 | A | | 12/1979 | Hvizdos et al. | |
| 4,582,519 | A | | 4/1986 | Someya et al. | |
| 4,778,497 | A | | 10/1988 | Hanson et al. | |
| 5,473,900 | A | | 12/1995 | Low | |
| 5,651,269 | A | | 7/1997 | Prevost et al. | |
| 5,669,234 | A | | 9/1997 | Houser et al. | |
| 5,755,114 | A | | 5/1998 | Foglietta | |
| 5,768,912 | A | | 6/1998 | Dubar | |
| 5,836,173 | A | | 11/1998 | Lynch et al. | |
| 5,916,260 | A | | 6/1999 | Dubar | |
| 5,931,021 | A | | 8/1999 | Shnaid et al. | |
| 5,992,175 | A | * | 11/1999 | Yao et al. | 62/621 |
| 6,006,545 | A | | 12/1999 | Tranier | |
| 6,062,041 | A | | 5/2000 | Kikkawa et al. | |
| 6,070,429 | A | | 6/2000 | Low et al. | |
| 6,085,545 | A | | 7/2000 | Johnston | |
| 6,105,391 | A | | 8/2000 | Capron | |
| 6,220,053 | B1 | | 4/2001 | Hass, Jr. et al. | |
| 6,250,244 | B1 | | 6/2001 | Dubar et al. | |
| 6,269,656 | B1 | | 8/2001 | Johnston | |
| 6,367,286 | B1 | | 4/2002 | Price | |
| 6,378,330 | B1 | * | 4/2002 | Minta et al. | 62/613 |
| 6,389,844 | B1 | | 5/2002 | Klein Nagel Voort | |
| 6,412,302 | B1 | * | 7/2002 | Foglietta | 62/611 |
| 6,446,465 | B1 | | 9/2002 | Dubar | |
| 6,484,533 | B1 | | 11/2002 | Allam et al. | |
| 6,564,578 | B1 | | 5/2003 | Fischer-Calderon | |
| 6,581,409 | B2 | | 6/2003 | Wilding et al. | |
| 6,694,774 | B1 | | 2/2004 | Rashad et al. | |
| 6,722,157 | B1 | | 4/2004 | Eaton et al. | |
| 6,742,357 | B1 | | 6/2004 | Roberts | |
| 6,751,985 | B2 | | 6/2004 | Kimble et al. | |
| 6,763,680 | B2 | | 7/2004 | Fischer et al. | |
| 6,886,362 | B2 | | 5/2005 | Wilding et al. | |
| 6,889,523 | B2 | | 5/2005 | Wilkinson et al. | |
| 6,962,061 | B2 | | 11/2005 | Wilding et al. | |
| 7,000,427 | B2 | | 2/2006 | Mathias et al. | |
| 7,086,251 | B2 | | 8/2006 | Roberts | |
| 7,204,100 | B2 | | 4/2007 | Wilkinson et al. | |
| 7,219,512 | B1 | | 5/2007 | Wilding et al. | |
| 7,228,714 | B2 | * | 6/2007 | Howard | 62/613 |
| 7,234,321 | B2 | | 6/2007 | Maunder et al. | |
| 7,637,121 | B2 | | 12/2009 | Owen et al. | |
| 2003/0089125 | A1 | | 5/2003 | Fredheim et al. | |
| 2004/0187520 | A1 | | 9/2004 | Wilkinson et al. | |
| 2004/0255616 | A1 | * | 12/2004 | Maunder et al. | 62/611 |
| 2005/0247078 | A1 | | 11/2005 | Wilkinson et al. | |
| 2005/0268649 | A1 | | 12/2005 | Wilkinson et al. | |
| 2005/0279133 | A1 | * | 12/2005 | Eaton | 62/613 |
| 2006/0213222 | A1 | | 9/2006 | Whitesell | |
| 2008/0148770 | A1 | * | 6/2008 | Migliore et al. | 62/612 |

FOREIGN PATENT DOCUMENTS

| | | | | | |
|---|---|---|---|---|---|
| WO | WO 2007/021351 | A1 | | 2/2007 | |
| WO | WO 2007021351 | A1 | * | 2/2007 | 62/611 |
| WO | WO 2008/136884 | A1 | | 11/2008 | |

OTHER PUBLICATIONS

European Search Report No. 113084 dated Feb. 23, 2006 for 2005UR027, 4 pages.
PCT International Search Report and Written Opinion dated Nov. 29, 2006 for 2005UR027/2, 7 pages.

* cited by examiner

NATURAL GAS LIQUEFACTION PROCESSES WITH FEED GAS REFRIGERANT COOLING LOOPS

CROSS REFERENCE TO RELATED APPLICATIONS

This application is the National Stage of International Application No. PCT/US2008/008027, filed 26 Jun. 2008, which claims the benefit of U.S. Provisional Application No. 60/966,022, filed 24 Aug. 2007.

TECHNICAL FIELD

Embodiments of the invention relate generally to the liquefaction of gases, and more specifically liquefaction of natural gas, particularly the liquefaction of gases in remote locations.

BACKGROUND

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

In the design of an LNG plant, one of the most important considerations is the process for converting the natural gas feed stream into LNG. Currently, the most common liquefaction processes use some form of refrigeration system. Although many refrigeration cycles have been used to liquefy natural gas, the three types most commonly used in LNG plants today are: (1) the "cascade cycle," which uses multiple single component refrigerants in heat exchangers arranged progressively to reduce the temperature of the gas to a liquefaction temperature; (2) the "multi-component refrigeration cycle," which uses a multi-component refrigerant in specially designed exchangers; and (3) the "expander cycle," which expands gas from feed gas pressure to a low pressure with a corresponding reduction in temperature. Most natural gas liquefaction cycles use variations or combinations of these three basic types.

The refrigerants used may be a mixture of components such as methane, ethane, propane, butane, and nitrogen in multi-component refrigeration cycles. The refrigerants may also be pure substances such as propane, ethylene, or nitrogen in "cascade cycles." Substantial volumes of these refrigerants with close control of composition are required. Further, such refrigerants may have to be imported and stored imposing logistics requirements. Alternatively, some of the components of the refrigerant may be prepared, typically by a distillation process integrated with the liquefaction process.

The use of gas expanders to provide the feed gas cooling thereby eliminating or reducing the logistical problems of refrigerant handling has been of interest to process engineers. The expander system operates on the principle that the feed gas can be allowed to expand through an expansion turbine, thereby performing work and reducing the temperature of the gas. The low temperature gas is then heat exchanged with the feed gas to provide the refrigeration needed. Supplemental cooling is typically needed to fully liquefy the feed gas and this may be provided by additional refrigerant systems, such as secondary cooling loops. The power obtained from cooling expansions in gas expanders can be used to supply part of the main compression power used in the refrigeration cycle. Though a typical expander cycle for making LNG can operate at the feed gas pressure, typically under about 5,516 kPa (800 psia), a high pressure primary cooling loop had been found to be particularly promising. See, for example, WO 2007/021351. It has also been discovered that adding external cooling to such a primary cooling loop provides additional advantages in many situations. See PCT/US08/02861.

Because expander cycles result in a high recycle gas stream flow rate and resulting high cooling load, introducing inefficiencies for the primary cooling (warm) stage, gas expander processes such as described above further cool the feed gas after it has been pre-cooled using a refrigerant in a secondary cooling unit. For example, U.S. Pat. No. 6,412,302 and U.S. Pat. No. 5,916,260 present expander cycles which describe the use of nitrogen as refrigerant in the sub-cooling loop. The primary (warm-end) expander cooling loop operates at low pressure and therefore limits the fraction of the feed gas cooling load provided by this primary loop. Consequently, a nitrogen (or nitrogen-rich) refrigerant is required in the sub-cooling loop. WO 2007/021351 (above) uses a portion of the flash gas derived from the feed gas in the final separation unit. Thus, generally, an element in expander cycle processes is the requirement for at least one second refrigeration cycle to sub-cool the feed gas before it enters the final expander for conversion of much, if not all, remaining gaseous feed to LNG.

Though this process performs comparably to alternative mixed external refrigerant LNG Production processes, including mixed expander-refrigerant processes, it has been of interest to improve the efficiency of the process of expander cycles for making LNG. In particular it has been of interest to use less fuel and reduce the power generation equipment required, especially for hard to reach locations, such as offshore or in environmentally severe onshore locations.

Other potentially relevant information may be found in International Publication No. WO2007/021351; Foglietta, J. H., et al., "Consider Dual Independent Expander Refrigeration for LNG Production New Methodology May Enable Reducing Cost to Produce Stranded Gas," Hydrocarbon Processing, Gulf Publishing Co., vol. 83, no. 1, pp. 39-44 (January 2004); U.S. App. No. US2003/089125; U.S. Pat. No. 6,412,302; U.S. Pat. No. 3,162,519; U.S. Pat. No. 3,323,315; and German Pat. No. DE19517116.

SUMMARY OF THE INVENTION

The invention is a process for liquefying a gas stream, particularly one rich in methane, said process comprising: (a) providing said gas stream at a pressure of from 600 to 1,000 psia as a feed gas stream; (b) providing a refrigerant at a pressure of less than 1,000 psia; (c) compressing said refrigerant to a pressure greater than or equal to 1,500-5,000 psia to provide a compressed refrigerant; (d) cooling said compressed refrigerant by indirect heat exchange with a cooling fluid; (e) expanding the refrigerant of (d) to cool said refrigerant, thereby producing an expanded, cooled refrigerant at a pressure of from greater than or equal to 200 psia to less than or equal to 1,000 psia; (f) passing said expanded, cooled refrigerant to a first heat exchange area; (g) compressing the gas stream of (a) to a pressure of from greater than or equal to 1,000 psia to less than or equal to 4,500 psia; (h) cooling said compressed gas stream by indirect heat exchange with an external cooling fluid; and, (i) passing said compressed gas stream through the first heat exchange area to cool at least a part thereof by indirect heat exchange, thereby forming a compressed, further cooled gas stream.

In a preferred embodiment, the feed gas stream in (g) is compressed to 1,500 to 4,000 psia (10342 to 27579 kPa), more preferably 2,500 to 3,500 psia (17237 to 24132 kPa), for optimization of overall power requirements for the gas, methane-rich gas, or natural gas, liquefaction.

In another embodiment of the present invention a system for treating a gaseous feed stream is provided. The system includes: a gaseous feed stream; a first refrigeration loop having a refrigerant stream, a first compression unit, and a first cooler configured to produce a compressed, cooled refrigerant stream; a second compression unit configured to compress the gaseous feed stream to greater than 1,000 psia (8,274 kPa) to form a compressed gaseous feed stream; a second cooler configured to cool the compressed gaseous feed stream to form a compressed, cooled gaseous feed stream, wherein the second cooler utilizes an external cooling fluid; and a first heat exchange area configured to further cool the compressed, cooled gaseous feed stream at least partially by indirect heat exchange with the compressed, cooled refrigerant stream to produce a sub-cooled, compressed, cooled gaseous feed stream.

DETAILED DESCRIPTION

Embodiments of the present invention provide increased efficiencies by taking advantage of elevating the pressure of the feed gas stream for subsequent heat exchange cooling in both a primary cooling loop and one or more secondary cooling loops. Additional benefit or improvement of the elevated pressure results when a portion of the cooled, elevated feed pressure stream is extracted and used as the refrigerant in a sub-cooling loop. In the prior art, the feed gas is provided typically at a pressure less than about 800 psia (5516 kPa). To enhance cooling the feed gas may be combined with one or more cooling streams of the secondary cooling loops, particularly where such cooling stream, or streams, consists of recycled feed gas or fractions or portions thereof. However, in doing so, the feed stream and provided cooling stream must typically be at the same pressure so as to allow piping, joints and flanges to be economically sized and constructed with characteristics suitable to the larger volume feed gas stream and to minimize the number of streams passing through each heat exchange area. Operating the primary heat exchange at this low pressure limits the thermodynamic performance since an ideal matching of the cooling curve of the feed gas to the warming curve of the primary refrigerant cannot be achieved. Further, since the pressure of the primary refrigerant stream is fixed by the primary heat exchanger cold end temperature, the refrigerant stream condition cannot be changed to better match the cooling curve of the feed stream.

Figure 3A:
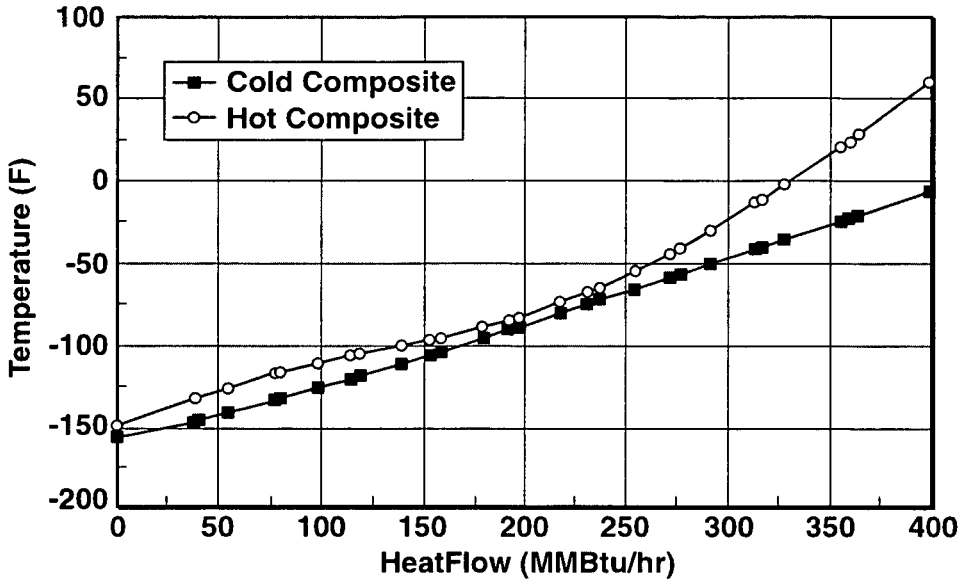
FIG. 3 represents the respective cooling curves for heat exchanger 50 at conventional low feed gas pressure (FIG. 3A) and the invention process elevated feed gas pressure (FIG. 3B).
Figure 3B:
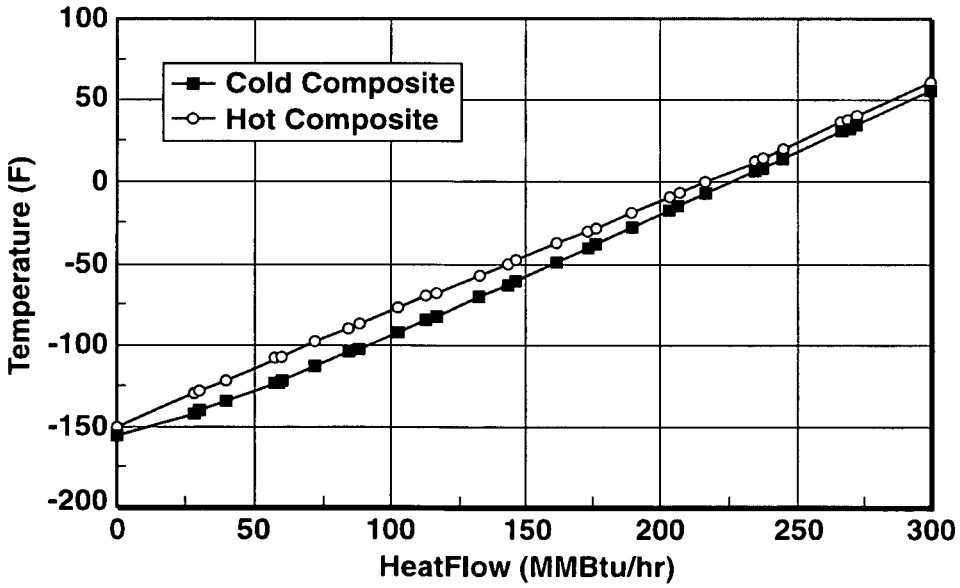

The improved embodiments of the present invention involve operating the feed gas and/or the secondary cooling stream at elevated pressures and employing heat exchangers capable of high-pressure operation (e.g., printed circuit heat exchangers manufactured by the Heatric Company, now part of Meggitt Ltd. (UK)). Operation at the elevated pressures allows reduction of the refrigeration load, or cooling requirement, in the primary heat exchange unit and allows a better match of the composite cooling curves in it. As shown below in data Table 1 the cooling load for the feed gas stream 10*b* from the inlet to exchanger 50 to the exchanger 55 outlet at 10*d* is reduced by 16% as the pressure is increased from 1,000 psia (6895 kPa) to 3,000 psia (20,684 kPa). As noted, operating at high pressure allows a shift of the cooling load from the high pressure primary cooling loop 5 to the ambient cooling units 35 and 37 that require no compression. Further, as shown in FIGS. 3A and 3B, the cooling curves are better matched at the higher pressure 3000 psia (20684 kPa) in FIG. 3B and pinched at the lower pressure of 800 psia (5516 kPa) in FIG. 3A for cooling the feed gas stream 10*b* in exchanger 50 to provide cooled stream 10*c*. This results in significant improvement in the overall performance of the process of WO 2007/021351.

Figure 1:
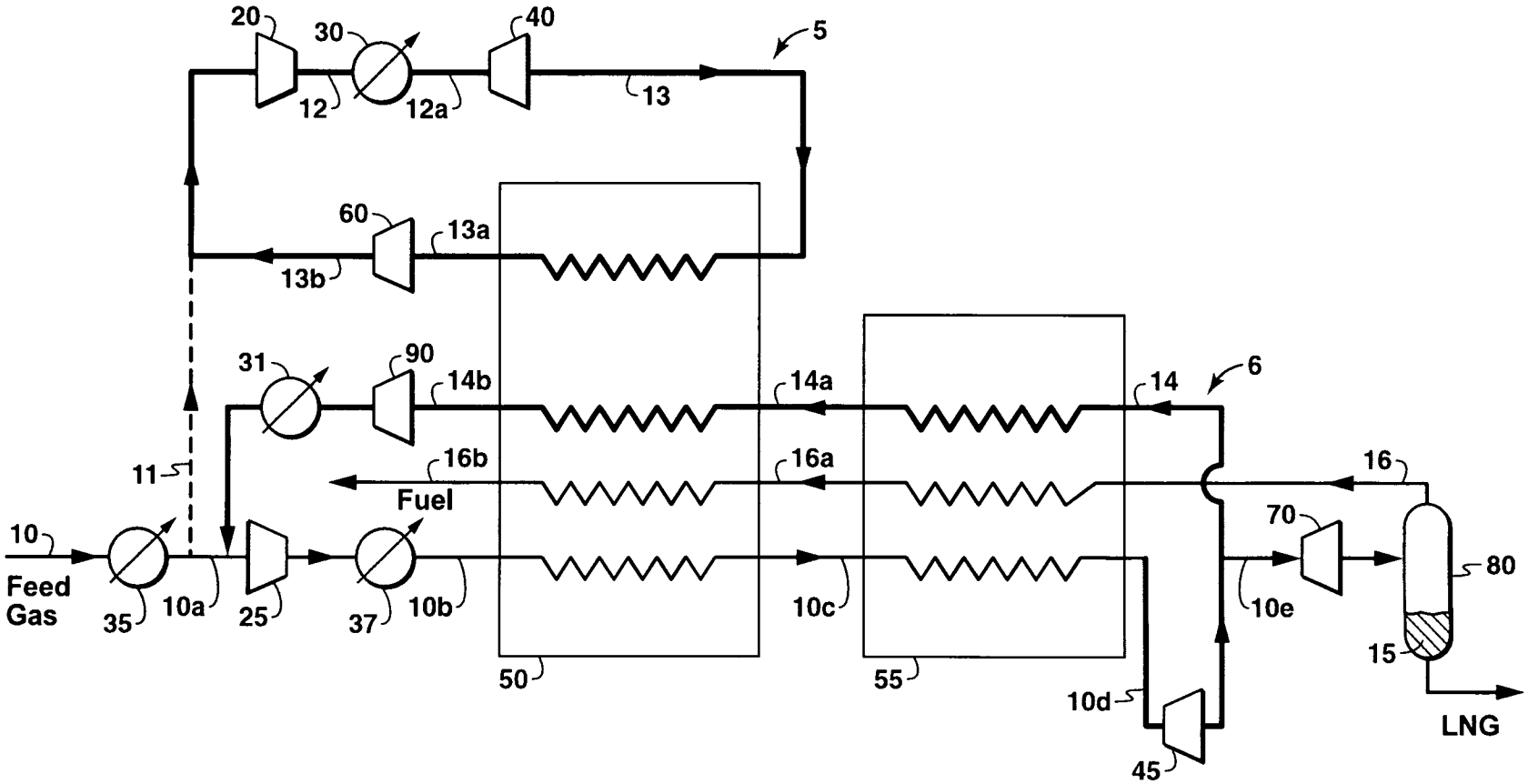
FIG. 1 is a schematic flow diagram of one embodiment for producing LNG in accordance with the process of this invention where the feed gas stream 10 is compressed in accordance with the invention prior to being cooled by the primary cooling loop 5 which optionally may use a portion of the feed gas 11, before the compression, as the primary cooling loop 5 refrigerant, and a portion of the expanded, cooled feed gas 10*d* is used as a refrigerant in a secondary cooling loop 6.

FIG. 1 illustrates one embodiment of the present invention in which a high pressure primary expander loop 5 (i.e., an expander cycle) and a sub-cooling loop 6 are used. In this specification and the appended claims, the terms "loop" and "cycle" are used interchangeably. In FIG. 1, feed gas stream 10 enters the liquefaction process at a pressure less than about 1,200 psia (8274 kPa), or less than about 1,100 psia (7584 kPa), or less than about 1,000 psia (6895 kPa), or less than about 900 psia (6205 kPa), or less than about 800 psia (5516 kPa), or less than about 700 psia (4826 kPa), or less than about 600 psia (4137 kPa). Typically, the pressure of feed gas stream 10 will be about 800 psia (5516 kPa). Feed gas stream 10 generally comprises natural gas that has been treated to remove contaminants using processes and equipment that are well known in the art. Optionally, after being passed through an external refrigerant cooling unit 35, typically at ambient cooling temperature, a portion of feed gas stream 10 is withdrawn to form side stream 11, thus providing, as will be apparent from the following discussion, a refrigerant at a pressure corresponding to the pressure of feed gas stream 10, namely any of the above pressures, including a pressure of less than about 1,200 psia (8274 kPa).

The refrigerant for the primary expander loop 5 may be any suitable gas component, preferably one available at the processing facility, and most preferably, as shown, is a portion of the methane-rich feed gas stream 10. Thus, in the embodiment shown in FIG. 1, a portion of the feed gas stream 10 is used as the refrigerant for expander loop 5. The embodiment shown in FIG. 1 utilizes a side stream that is withdrawn from feed gas stream 10 before feed gas stream 10 is passed to a compressor, the side stream 11 of feed gas to be used as the refrigerant in expander loop 5 may be withdrawn from the feed gas stream 10 before the feed gas stream 10*a* has been passed to the initial cooling unit 35. Thus, in one or more embodiments, the present method is any of the other embodiments herein described, wherein the portion of the feed gas stream 11 to be used as the refrigerant is withdrawn prior to the heat exchange area 50, compressed, cooled and expanded, and passed back to the heat exchange area 50 to provide at least part of the refrigeration duty for that heat exchange area 50.

Thus side stream 11 is passed to compression unit 20 where it is compressed to a pressure greater than or equal to about 1,500 psia (10,342 kPa), thus providing a compressed refrigerant stream 12. Alternatively, side stream 11 is compressed to a pressure greater than or equal to about 1,600 psia (11,032 kPa), or greater than or equal to about 1,700 psia (11,721 kPa), or greater than or equal to about 1,800 psia (12,411 kPa), or greater than or equal to about 1,900 psia (13,100 kPa), or greater than or equal to about 2,000 psia (13,789 kPa), or greater than or equal to about 2,500 psia (17,237 kPa), or greater than or equal to about 3,000 psia (20,684 kPa), thus providing compressed refrigerant stream 12. As used in this specification, including the appended claims, the term "compression unit" means any one type or combination of similar or different types of compression equipment, and may include auxiliary equipment, known in the art for compressing a substance or mixture of substances. A "compression unit" may utilize one or more compression stages. Illustrative compressors may include, but are not limited to, positive displacement types, such as reciprocating and rotary compressors for example, and dynamic types, such as centrifugal and axial flow compressors, for example.

After exiting compression unit 20, compressed refrigerant stream 12 is passed to cooler 30 where it is cooled by indirect heat exchange with ambient air or water to provide a compressed, cooled refrigerant 12*a*. The temperature of the compressed refrigerant stream 12*a* as it emerges from cooler 30 depends on the ambient conditions and the cooling medium used and is typically from about 35° F. (1.7° C.) to about 105° F. (40.6° C.). Where the ambient temperature is in excess of 50° F. (10° C.), more preferably in excess of 60° F. (15.6° C.), or most preferably in excess of 70° F. (21.1° C.), the stream 12*a* is optionally passed through a supplemental cooling unit (not shown), operating with external coolant fluids, such that the compressed refrigerant stream 12*a* exits said cooling unit at a temperature that is cooler than the ambient temperature. The external refrigerant cooled compressed refrigerant stream 12*a* is then expanded in a turbine expander 40 before being passed to heat exchange area 50. Depending on the temperature and pressure of compressed refrigerant stream 12*a*, expanded stream 13 may have a pressure from about 100 psia (689 kPa) to about 1,000 psia (6895 kPa) and a temperature from about −100° F. (−73° C.) to about −180° F. (−118° C.). In an illustrative example, stream 13 will have a pressure of about 302 psia (2082 kPa) and a temperature of −162° F. (−108° C.). The power generated by the turbine expander 40 is used to offset the power required to re-compress the refrigerant in loop 5 in compressor units 60 and 20. The power generated by the turbine expander 40 (and, any of the turbine expanders to be used) may be in the form of electric power where it is coupled to a generator, or mechanical power through a direct mechanical coupling to a compressor unit.

As used in this specification, including the appended claims, the term "heat exchange area" means any one type or combination of similar or different types of equipment known in the art for facilitating heat transfer. Thus, a "heat exchange area" may be contained within a single piece of equipment, or it may comprise areas contained in a plurality of equipment pieces. Conversely, multiple heat exchange areas may be contained in a single piece of equipment.

Upon exiting heat exchange area 50, expanded refrigerant stream 13*a* is fed to compression unit 60 for pressurization to form stream 13*b*, which is then joined with side stream 11. It will be apparent that once expander loop 5 has been filled with feed gas from side stream 11, only make-up feed gas to replace losses from leaks is required, the majority of the gas entering compressor unit 20 generally being provided by stream 13*b*. The portion of feed gas stream 10 that is not withdrawn as side stream 11 is passed to heat exchange area 50 where it is cooled, at least in part, by indirect heat exchange with expanded refrigerant stream 13 and becomes a cooled fluid stream that may comprise liquefied gas, cooled gas, and/or two-phase fluid.

Thus the portion of feed gas stream 10 not withdrawn as side stream 11 is passed to a compressor, such as a turbine compressor 25, and then subjected to optional cooling with one or more external refrigerant units 37 to remove at least a portion of the heat of compression. There the feed gas stream 10*a* is compressed to a pressure greater than or equal to about 1,000 psia (6895 kPa), thus providing a compressed feed gas stream 10*b*. Alternatively, side stream 10*a* is compressed to a pressure greater than or equal to about 1,500 psia (10342 kPa), or greater than or equal to about 2,000 psia (13789 kPa), or greater than or equal to about 2,500 psia (17237 kPa), thus providing compressed feed gas stream 10*b*. The pressure need not exceed 4,500 psia (31026 kPa), as noted earlier, and preferably not exceed 3,500 psia (24132 kPa). Compressed feed gas stream 10*b* then enters heat exchange area 50 where cooling is provided by streams from primary cooling loop 5, secondary cooling loop 6, optionally, as shown, with flash gas stream 16.

After exiting heat exchange area 50, feed gas stream 10*c* is optionally passed to heat exchange area 55 for further cooling. The principal function of heat exchange area 55 is to sub-cool the feed gas stream. Thus, in heat exchange area 55 feed gas stream 10*c* is preferably sub-cooled by a sub-cooling loop 6 (described hereinafter) to produce sub-cooled fluid stream 10*d*. Sub-cooled fluid stream 10*d* is then expanded to a lower pressure in expander 45, thereby cooling further said stream. A portion of fluid stream 10*d* is taken off for use as the loop 6 refrigerant stream 14. The portion of fluid stream 10*d* not taken off forms stream 10*e* which is optionally passed to an expander 70 to additionally cool sub-cooled fluid stream 10*e* to form principally a liquid fraction and a remaining vapor fraction. Expander 70 may be any pressure reducing device, including, but not limited to a valve, control valve, Joule-Thompson valve, Venturi device, liquid expander, hydraulic turbine, and the like. The largely liquefied sub-cooled stream 10*e* is passed to a separator, e.g., surge tank 80 where the liquefied portion 15 is withdrawn from the process as LNG having a temperature corresponding to the bubble point pressure. The remaining vapor portion (flash vapor) stream 16 is used as fuel to power the compressor units and may be optionally used as a refrigerant in sub-cooling loop 6, as illustrated in FIG. 1. So, prior to being used as fuel, all or a portion of flash vapor stream 16 may optionally be passed from surge tank 80 to heat exchange areas 50 and 55 to supplement the cooling provided in those heat exchange areas. The flash vapor stream 16 may also be used as the refrigerant, or to supplement the refrigerant, in refrigeration loop 5, not shown.

The refrigerant stream 14 of sub-cooling loop 6 is led through heat exchange area 55 to provide part of the heat removal duty and exits as stream 14*a*, which in turn is provided to heat exchange area 50 for further heat removal duty. The thus warmed stream exits as stream 14*b* which is compressed in compressor unit 90, and then cooled in cooling unit 31, which can be an ambient temperature air or water external refrigerant cooler, or may comprise any other external refrigerant unit(s). This compressed, cooled stream 14*b* is then added to feed gas stream 10*a*, thus completing loop 6.

Figure 2:
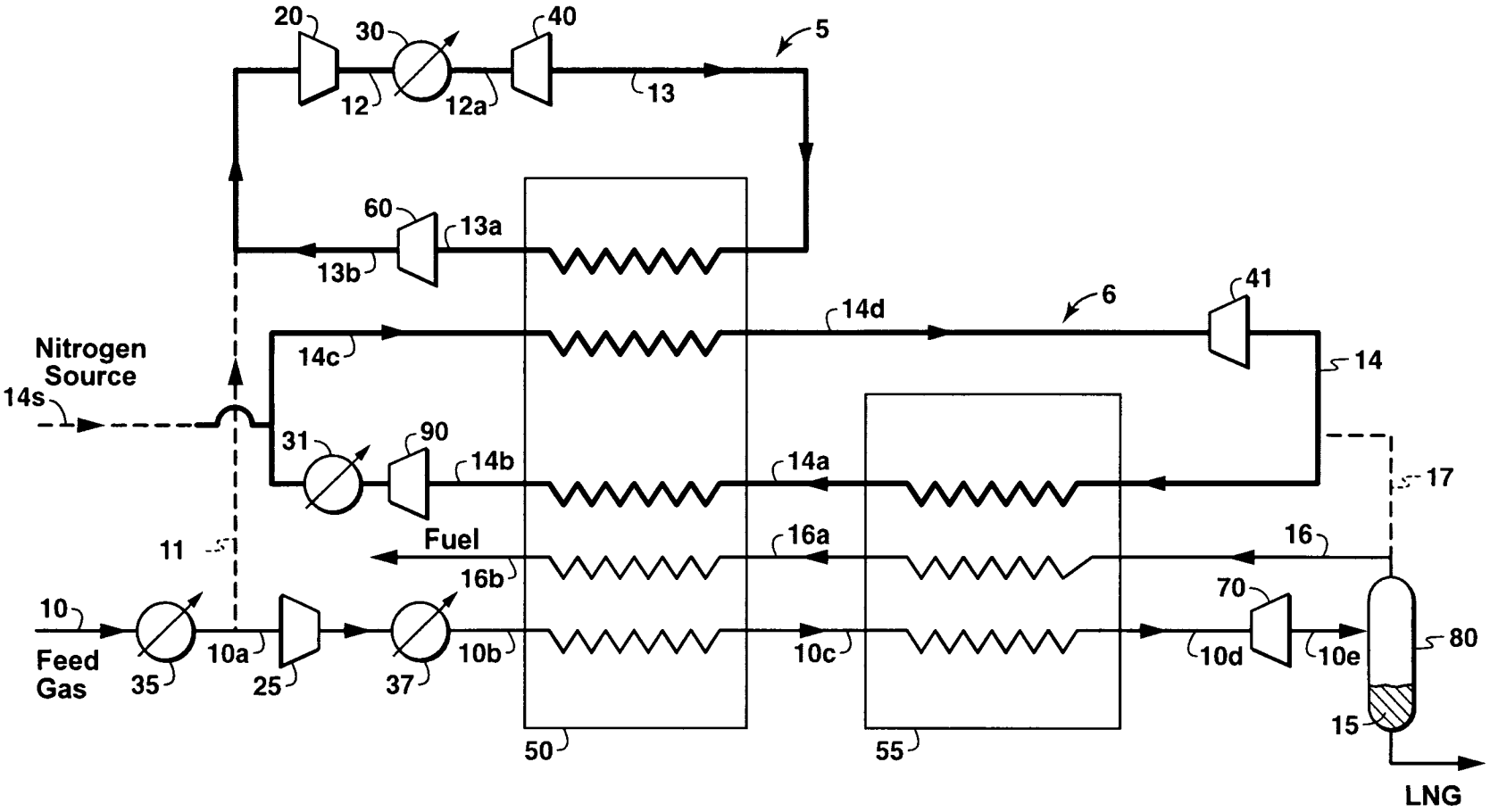
FIG. 2 is a preferred embodiment where the secondary cooling loop 6 is a closed loop using nitrogen gas, or a nitrogen-rich gas, or a portion of the flash gas 17 from a gas-liquid separation unit 80.

Referring now to FIG. 2, sub-cooling loop 6 is a closed loop utilizing nitrogen, or nitrogen-containing gas as refrigerant stream 14. Stream 14 can typically be provided from bottled sources, or from other contiguous air separation and treatment processes, and will be provided typically at a temperature of about 60° F. (15.6° C.) to about 95° F. (35° C.) and a pressure of about 800 psia (5516 kPa) to about 2,500 psia (17237 kPa). Gaseous stream 14*d* is provided to expander 41 and exits expander 41 as gaseous stream 14 typically having a temperature from about −220° F. (−140° C.) to about −260° F. (−162° C.) (e.g. about −242° F. (−52° C.)) and a pressure of about 50 psia (345 kPa) to about 550 psia (3792 kPa). Stream 14 can be provided to heat exchange areas 55 and 50 as illustrated. The warmed stream 14*b*, after passing through the exchange areas, is then compressed in compression unit 90 and cooled in external refrigerant cooling unit 31, which can be of the same type as ambient temperature cooler 37, so as to be approximately at the original temperature and pressure of stream 14*s* for merging with or comprising stream 14*c*. After cooling, the re-compressed sub-cooling refrigerant stream 14*b* becomes stream 14*c*, and is passed to heat exchange area 50 where it is further cooled by indirect heat exchange with expanded refrigerant stream 13, sub-cooling refrigerant stream 14*a*, and, optionally, flash vapor stream 16*a* before returning to expander 41 as stream 14*d*.

Alternatively, in FIG. 2, a portion of flash vapor 16 is withdrawn through line 17 to fill sub-cooling loop 6. Thus, a portion of the feed gas from feed gas stream 10 after liquefaction is withdrawn (in the form of flash gas from flash gas stream 16) for use as the refrigerant by providing into the secondary expansion cooling loop, e.g., sub-cooling loop 6. It will again be apparent that once sub-cooling loop 6 is fully charged with flash gas, only make-up gas (i.e., additional flash gas from line 17) to replace losses from leaks is required. In sub-cooling loop 6, stream 14 is drawn through heat exchange areas 55 to become stream 14*a* and 50 to become stream 14*b*. The sub-cooling refrigerant stream 14*b* (the flash vapor stream) is then returned to compression unit 90 where it is re-compressed to a higher pressure and is warmed further. After exiting compression unit 90, the re-compressed sub-cooling refrigerant stream 14*b* is cooled in one or more external refrigerant cooling units (e.g., an ambient temperature cooler 31, as above). After cooling, the re-compressed sub-cooling refrigerant stream is passed to heat exchange area 50 where it is further cooled by indirect heat exchange with expanded refrigerant stream 13, sub-cooling refrigerant stream 14*a*, and, optionally, flash vapor stream 16. After exiting heat exchange area 50, the re-compressed and cooled sub-cooling refrigerant stream is expanded through expander 41 to provide a cooled stream which is then passed through heat exchange area 55 to sub-cool the portion of the feed gas stream to be finally expanded to produce LNG. The expanded sub-cooling refrigerant stream exiting from heat exchange area 55 is again passed through heat exchange area 50 to provide supplemental cooling before being re-compressed. In this manner the cycle in sub-cooling loop 6 is continuously repeated. Thus, in one or more embodiments, the present method is any of the other embodiments disclosed herein further comprising providing cooling using a closed loop (e.g., sub-cooling loop 6) charged with flash vapor resulting from the LNG production (e.g., flash vapor 16).

EXAMPLES

The below presented tables and description depict performance curves and comparisons developed using an Aspen HYSYS® (version 2006) process simulator, a computer aided design program from Aspen Technology, Inc., of Cambridge Mass. The enthalpy values are calculated using the HYSYS process simulator. The enthalpy values are negative because of the enthalpy reference basis used by HYSYS. In HYSYS, this enthalpy reference basis is the heat of formation at 25° C. and 1 atm (ideal gas).

Table 1 illustrates the cooling load reduction for expander loop 5 and subcooling loop 6 when the cooling loads are compared from operating the feed gas at 1,000 psia (6895 kPa) versus 3,000 psia (20684 kPa), as discussed above.

Tables 2 and 3 below illustrate flow rate, pressures, and power consumption data using the invention process where the feed gas pressure at the entry to the primary heat exchange (e.g., 50) was varied from 1,000 psia (6895 kPa) to 5,000 psia (34474 kPa) while keeping the temperature at the cold end of the primary heat exchanger 50 (at 10*c*) constant. The feed gas rate is kept constant and just enough fuel (for the embodiments in FIG. 1 or FIG. 2) is separated to provide a fuel source for power production. The feed gas used in this illustrative case is predominantly methane (e.g., about 96%) with about 4% nitrogen. A nitrogen rejection unit (not shown) for the LNG withdrawn from separation unit 80 will be typically in use.

The data of Table 2 and Table 3 illustrate the benefits of the invention on process performance. The flow rate through the primary loop 5 decreases monotonically as the pressure of the feed gas stream 10*b* to the heat exchange unit is elevated. This results in a reduction in the primary loop compression horsepower requirement. However, this reduction is partially offset by the increased compression requirement for both the feed gas 10*a* and the sub-cooling loop refrigerant in loop 6, to the elevated pressure. Consequently, the total horsepower (representing the installed compression power) and the net horsepower for the cycle (representing the installed turbine power) do not track the monotonic decrease in the primary loop power requirement. As the pressure of the feed gas increases, the contribution of the feed gas compression to the total compression power requirements becomes increasingly significant, eventually becoming the dominant incremental contributor so as to increase unacceptably the total compression power requirements. On the other hand, at lower feed gas pressures, the composite effect of the increased cooling requirement and the heat exchange inefficiency result in a high compression requirement in primary loop 5. As a consequence the total power requirement is higher. Accordingly optimum performance has been found unexpectedly to be in the ranges described and claimed in this application.

Further, as shown in Table 2 (below), the refrigerant flow rate through the primary loop 5 is reduced by more than a factor of two as the heat exchange pressure is increased from 1,000 psia (6895 kPa) to 5,000 (34474 kPa) psia. Table 3 shows a similar trend. The reduced flow rate enables the use of compact equipment that is particularly attractive for offshore gas processing applications.

The performance benefits of the invention, as shown by the data in Tables 2 and 3, show that the optimum performance was attained when the primary heat exchanger 50 was operated at a feed gas pressure between 2,000 psia (13789 kPa) and 4,000 psia (27579 kPa). However, there can be variations in the optimal heat exchange unit or feed gas pressure for a given process configuration, based on feed gas composition, feed gas supply pressure prior to compression, refrigerant composition, and the refrigerant pressure in loop 5, all of which can be determined empirically by those skilled in the art and informed by the description above. For the illustrative example provided, the optimum mode (least total compression power) was determined to be operation at about 2,750 psia (18961 kPa). The primary loop operating pressure for this illustrative example was fixed at 3,000 psia (20684 kPa).

TABLE 1

Cooling Load Reduction Using High Pressure

| Stream definition | Stream Condition Press. (psia/kPa) | Temp. (° F./° C.) | Enthalpy (BTU/lb)/(kJ/kg) | Total Cooling Load (BTU/lb)/(kJ/kg) | % Feed Load from Expander Cooling Loops | % Feed Load from Ambient Cooling (Water/Air) |
|---|---|---|---|---|---|---|
| Inlet Feed Gas (stream 10) | 1000/6895 | 95/35 | −1879/−4371 | 321/747 | | |
| Exchanger 50 Inlet (stream 10b) (low pressure) | 1000/6895 | 60/15.6 | −1901/−4422 | 299/696 | 93 | 7 |
| Exchanger Inlet (stream 10b) (elevated pressure) | 3000/20684 | 60/15.6 | −1949/−4536 | 251/582 | 78 | 22 |
| Exchanger 55 Outlet stream 10d | | −240/−151 | −2200/−5118 | | | |

The foregoing application is directed to particular embodiments of the present invention for the purpose of illustrating it. It will be apparent, however, to one skilled in the art, that many modifications and variations to the embodiments described herein are possible. All such obvious modifications and variations are intended to be within the scope of the present invention, as defined in the appended claims.

We claim:

1. A process for liquefying a gas stream, said process comprising:

(a) providing said gas stream at a pressure of from 600 to 1,000 psia (4,137-6,895 kPa) as a feed gas stream;

TABLE 2

Example Case: Natural Gas 1 using feed gas as sub-cooling loop refrigerant (FIG. 1 Configuration)

| Feed Pressure Psia/kPa | Primary Loop Flow Mmscfd/kg-mole/hr | Subcool Loop Flow Mmscfd/kg-mole/hr | Primary Loop Compression Power khp/MW | Subcool Loop Compression Power khp/MW | Feed Gas Compression Power khp/MW | Total Compression Power khp/MW | Expander Power khp/MW | Net Compression Power khp/MW |
|---|---|---|---|---|---|---|---|---|
| 5000/34474 | 950/47334 | 212.1/10564 | 120.8/90 | 62.1/46.3 | 66.8/49.8 | 267.4/199.4 | 53.30/39.7 | 214.1/159.7 |
| 4500/31026 | 977/48669 | 216.8/10798 | 124.2/93 | 61.5/45.9 | 61.0/45.5 | 264.4/197.2 | 53.16/39.6 | 211.2/157.5 |
| 4000/27579 | 1010/50303 | 222.5/11082 | 128.3/96 | 61.0/45.5 | 54.8/40.9 | 261.9/195.3 | 53.23/39.7 | 208.7/155.6 |
| 3500/24132 | 1052/52394 | 229.3/11420 | 133.8/100 | 60.5/45.1 | 48.2/35.9 | 260.0/193.9 | 53.73/40.1 | 206.3/153.8 |
| 3000/20684 | 1103/54934 | 237.6/11834 | 140.3/105 | 59.8/44.6 | 40.9/30.5 | 258.7/192.9 | 54.53/40.7 | 204.2/152.2 |
| 2500/17237 | 1180/58769 | 247.9/12347 | 149.9/112 | 60.0/44.7 | 32.9/24.5 | 260.5/194.3 | 56.42/42.1 | 204.1/152.2 |
| 2000/13789 | 1298/64646 | 261.1/13004 | 164.2/122 | 60.1/44.8 | 23.8/17.8 | 265.9/198.3 | 60.01/44.7 | 205.9/153.5 |
| 1500/10342 | 1550/77197 | 279.1/13900 | 193.3/144 | 59.9/44.7 | 13.2/9.9 | 284.1/211.9 | 69.19/51.6 | 214.9/160.3 |
| 1250/8618 | 1728/86062 | 291.0/14493 | 213.4/159 | 59.7/44.5 | 7.0/5.2 | 297.8/222.1 | 75.95/56.6 | 221.9/165.4 |
| 1000/6895 | 2112/105187 | 306.3/15255 | 255.1/190 | 58.7/43.8 | 0.0/0.0 | 331.5/247.2 | 91.34/68.1 | 240.2/179.1 |

TABLE 3

Example Case: Natural Gas 2 using nitrogen as sub-cooling loop refrigerant (FIG. 2 Configuration)

| Feed Pressure psia/kPa | Primary Loop Flow Mmscfd/Kg-mole/hr | Subcool Loop Flow mmscfd/kg-mole/hr | Primary Loop Compression Power khp/MW | Subcool Loop Compression Power khp/MW | Feed Gas Compression Power khp/MW | Total Compression Power khp/MW | Expander Power khp/MW | Net Compression Power khp/MW |
|---|---|---|---|---|---|---|---|---|
| 5000/34474 | 1417/70573 | 1061/52843 | 198/148 | 93.9/70.0 | 110.3/82.3 | 424/316 | 94.2/70.3 | 329.8/245.9 |
| 4500/31026 | 1448/72117 | 1075/53540 | 203/151 | 95.4/71.2 | 100.6/75.0 | 420/313 | 94.3/70.3 | 326.0/243.1 |
| 4000/27579 | 1487/74059 | 1092/54387 | 208/155 | 97.3/72.5 | 90.4/67.4 | 418/311 | 94.8/70.7 | 322.7/240.6 |
| 3500/24132 | 1534/76400 | 1112/55383 | 215/160 | 99.5/74.2 | 79.4/59.2 | 415/310 | 95.6/71.3 | 319.6/238.3 |
| 3000/20684 | 1592/79289 | 1135/56528 | 223/166 | 102.2/76.2 | 67.4/50.3 | 414/309 | 97.0/72.3 | 317.0/236.4 |
| 2500/17237 | 1675/83423 | 1163/57923 | 234/175 | 105.5/78.7 | 54.1/40.4 | 416/310 | 99.5/74.2 | 316.0/235.6 |
| 2000/13789 | 1799/89598 | 1199/59716 | 251/187 | 109.6/81.7 | 39.2/29.2 | 421/314 | 104.0/77.6 | 316.9/236.3 |
| 1500/10342 | 2010/100107 | 1247/62106 | 277/207 | 115.4/86.1 | 21.7/16.2 | 436/325 | 112.4/83.8 | 323.4/241.2 |
| 1000/6895 | 2487/123864 | 1313/65393 | 334/249 | 123.7/92.2 | 0.0/0.0 | 479/357 | 132.8/99.0 | 346.1/258.1 |

(b) providing a refrigerant at a pressure of less than 1,000 psia (6,895 kPa) by withdrawing a portion of said gas stream for use as said refrigerant;

(c) compressing said refrigerant in a closed loop to a pressure greater than or equal to 1,600 to less than or equal to 5,000 psia (11,032 to 34,474 kPa) to produce a compressed refrigerant;

(d) cooling said compressed refrigerant by indirect heat exchange with a cooling fluid;

(e) expanding the compressed refrigerant of (d) to cool said compressed refrigerant, to produce an expanded, cooled refrigerant at a pressure of from greater than or equal to 100 psia (689 kPa) to less than or equal to 1,000 psia (6895 kPa);

(f) passing said expanded, cooled refrigerant to a first heat exchange area;

(g) compressing the feed gas stream of (a) to a pressure of from greater than or equal to 2,500 psia (17,237 kPa) to less than or equal to 3,500 psia (24,132 kPa) to produce a compressed feed gas stream;

(h) cooling said compressed feed gas stream by indirect heat exchange with an air or water refrigerant cooler;

(i) passing said compressed feed gas stream through the first heat exchange area to cool at least a part thereof by indirect heat exchange, to produce a compressed, further cooled feed gas stream, wherein the feed gas is used as the only refrigerant such that no external refrigerants are used, except for water or air;

(j) passing the compressed, further cooled feed gas stream of (i) through a second heat exchange area for extra cooling; and (k) expanding said compressed, further cooled feed gas stream of (j) to reduce the pressure of said compressed, further cooled feed gas stream to a pressure of from greater than or equal to 50 psia (345 kPa) to less than or equal to 450 psia (3103 kPa) to produce an expanded, cooled gas stream; and (l) withdrawing a portion not to exceed 50% of said expanded, cooled gas stream of (k) and reducing its pressure in a reduction valve to a range of about 30-200 psia (207-1379 kPa) to produce a reduced pressure gas stream and passing the reduced pressure gas stream through the second heat exchange area of (j) as a cooling gas stream.

2. The process of claim 1, further comprising passing the cooling gas stream through the first heat exchange area to assist cooling of said compressed feed gas stream.

3. The process of claim 2, further comprising subsequently compressing and cooling the cooling gas stream by indirect heat exchange with an external cooling unit, one or more times, and adding the cooling gas stream to the feed gas stream of 1(a) prior to the compressing of said feed gas stream in 1 (g).

4. The process of claim 1, further comprising expanding at least a second portion of said expanded, cooled gas stream; and passing the expanded second portion to a separation tank from which liquid natural gas is withdrawn and remaining gaseous vapors are withdrawn as flash gas.

5. The process of claim 4 wherein said first heat exchange area and said second heat exchange area are provided with a sub-cooling expander loop cooling stream comprising said flash gas from the final separation of the liquefied feed gas stream.

6. The process of claim 5 wherein said sub-cooling expander loop cooling stream flows in a closed loop comprising compressing said sub-cooling expander loop cooling stream after passing through said first heat exchange area and said second heat exchange area, cooling with at least one external refrigerant cooling unit, and expanding said sub-cooling expander loop cooling stream prior to providing to the first and second heat exchange areas.

7. The process of claim 6 wherein said sub-cooling expander loop cooling stream comprises nitrogen or nitrogen-containing gas.

8. The process of claim 6 wherein said sub-cooling expander loop cooling stream comprises a portion of said flash gas and the remaining portion of the flash gas is passed through one or both of the first and second heat exchange areas as a cooling fluid stream before being routed for use as a fuel source.

* * * * *